US005505681A

United States Patent [19]

Bruggemann

[11] Patent Number: 5,505,681

[45] Date of Patent: Apr. 9, 1996

[54] PORTABLE ATHLETIC EXERCISER PULLING DEVICE

[76] Inventor: Thomas J. Bruggemann, 15205 S. Grevillea Ave., Lawndale, Calif. 90260

[21] Appl. No.: 489,797

[22] Filed: Jun. 13, 1995

[51] Int. Cl.[6] ..... A63B 69/00

[52] U.S. Cl. ..... 482/127; 482/121; 482/904

[58] Field of Search ..... 482/121, 114, 482/907, 124, 126, 127, 129, 148, 904, 907, 908, 131, 133, 136, 115, 116

[56] References Cited

U.S. PATENT DOCUMENTS

| | | | |
|---|---|---|---|
| 518,967 | 5/1894 | Poole | 482/116 |
| 1,324,404 | 12/1919 | Metzger | 482/127 |
| 4,591,151 | 5/1986 | Hensley | 482/126 |
| 4,603,856 | 8/1986 | Fiore | 482/114 |
| 4,871,165 | 10/1989 | Marshall et al. | 482/116 |
| 5,269,512 | 12/1993 | Crowson et al. | 482/129 |

*Primary Examiner*—Stephen R. Crow
*Attorney, Agent, or Firm*—Monty Koslover Assoc.

[57] ABSTRACT

A device for athletic exercise by pulling at a resisting force. The device consists of a small cylindrical enclosure containing a number of constant force, circular wound spring assemblies, having a pulley molded to the enclosure, and having a force selector assembly connected to the enclosure which also serves to hold the device in any fixed location. A cord is wound around the pulley during assembly and its free end is attached to a pull-handle. A person uses the force selector by manually moving a spring-loaded adjustment knob through slots in the selector assembly to a slot which corresponds to the desired force level. This action causes a spring-engagement rod inside the selector assembly to engage the number of spring assemblies that will produce the selected resisting force when a person pulls at the pull handle. The device is small and light in weight. Provision is made for attachment of the device to any suitable restraining object or static equipment.

4 Claims, 3 Drawing Sheets

Fig. 3.
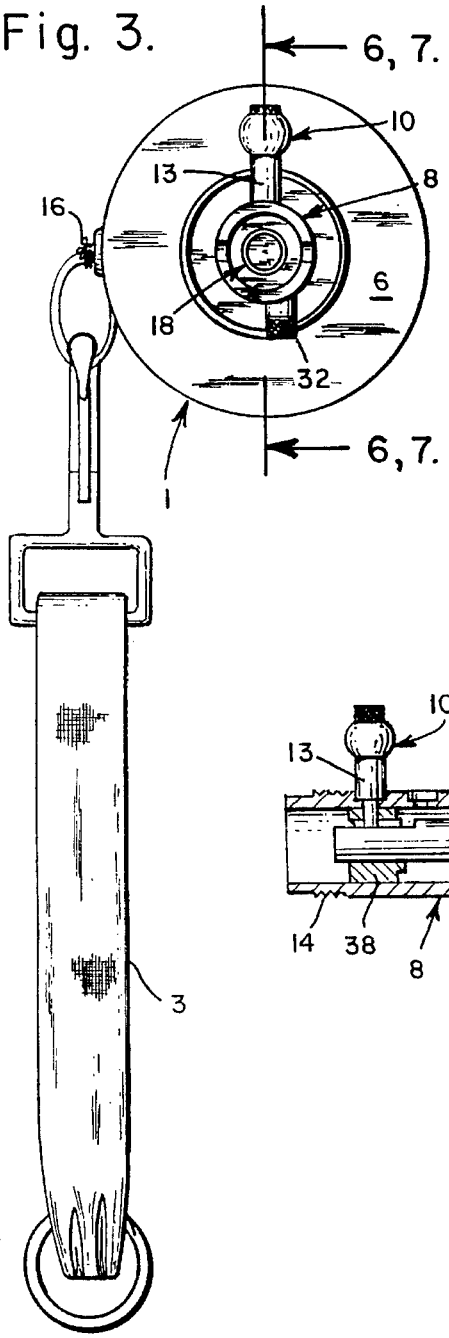
Fig. 4.
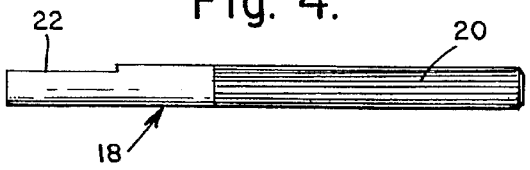
Fig. 5.
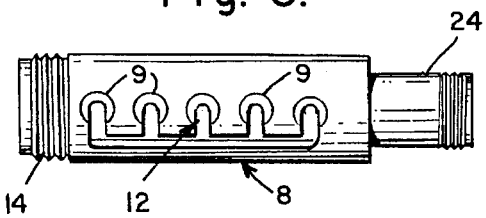
Fig. 6.
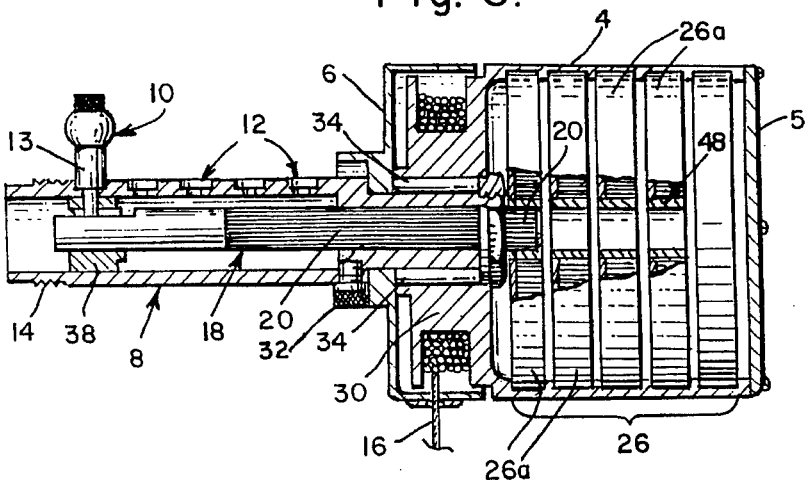
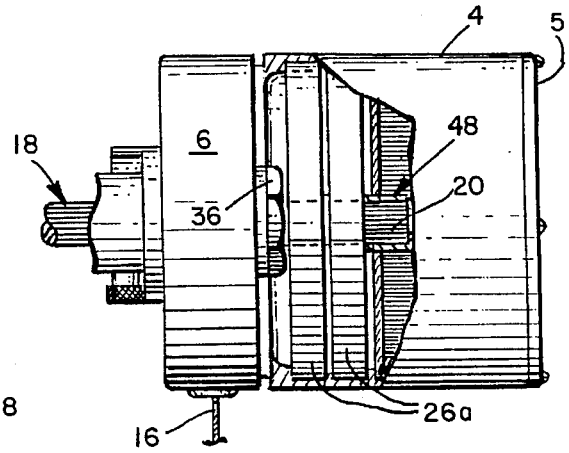
Fig. 7.
Fig. 8.
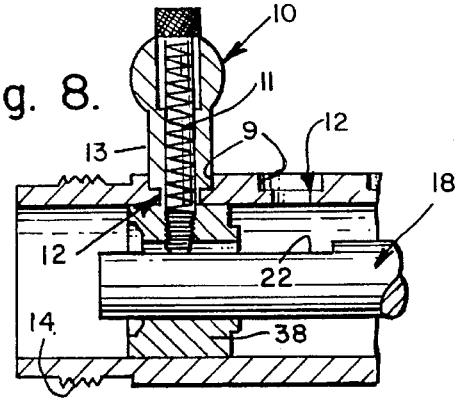

PORTABLE ATHLETIC EXERCISER PULLING DEVICE

BACKGROUND OF THE INVENTION

1. Field of the Invention

The invention is an equipment used for athletic exercise, and more particularly, it is a portable device used to exercise and strengthen the muscles by pulling at the device.

2. Background

In the field of athletic exercise devices, there presently exist many different types available to the public. This invention is directed only to those devices which are used to strengthen the muscles by pulling at the device. Devices of this type are available in exercise establishments, where the user sits or stands and pulls at bars with his hands and/or feet. The pull bars are usually attached by rope or cable through pulleys to weights, and in most equipments, these weights, may be adjusted to suit the exerciser's needs. This type of equipment can not be considered as being portable and is certainly not inexpensive.

There also exist a number of hand and/or foot pull devices which are either incorporated into furniture such as chairs, or which may be attached to furniture. All the known devices use external pulleys and cables attached to springs or weights. In some of these devices, the pulling force may be adjusted by the exerciser. These devices are usually not intended to be moved once they are installed and are not generally compact in size for easy packing and moving.

For people who travel frequently, the most practical place to exercise pulling a weight, is presently an exercise gym that has installed the required equipment. When such a facility is not available or convenient, the would-be exerciser must do without.

There is therefore a need for a small, compact pulling force exerciser equipment which is easily portable for packing and carrying, and which can be attached to a suitable fixed object for use.

SUMMARY OF THE INVENTION

The invention is a small device which can be clamped to any suitable immovable object, and having a pull handle attached to a cord which is wrapped around a pulley inside the device. An exerciser may pull at the pull handle at any of five pull forces that he selects. The device comprises a force selector assembly, a pulley housing, a pulley/spring housing and five constant force circular springs located inside the spring housing. As assembled, a force adjustment knob on the selector assembly is manually moved to a location choosing one of five force settings. This action causes one or more of the five spring assemblies to be engaged equivalent to the setting. When the exerciser pulls the pull handle away from the device, a constant pulling force will be felt at the level selected. The exerciser device is compact and weighs about three pounds, not including any clamping attachment.

An invention advantage is that it is easily portable, may be used anywhere and will take very little room in packing for travel.

Another advantage is the ease with which any of five different pulling force levels may be selected.

Yet another advantage is the low cost of the device as compared with similar exercise devices.

Accordingly, it is a principal object of this invention to provide a small, compact pulling force exerciser device which is easily portable for packing and carrying, and which can be attached to a suitable fixed object for use.

Another object is to provide a small, compact pulling force exerciser which has adjustable force settings.

Further objects and advantages of the invention will be apparent from studying the following portion of the specification, the claims and the attached drawings.

BRIEF DESCRIPTION OF THE DRAWINGS

FIG. 3 is an end view of the exercise device, particularly looking at the end of the device force selector assembly;

FIG. 4 is a side elevation view of the spring engagement rod which is located inside the force selector assembly;

FIG. 5 is a top plan view of the force selector housing, particularly showing five adjustment slots for force selection;

FIG. 6 is a side elevation cut-away view of the invention device taken along line 6—6 of FIG. 3, particularly showing the spring engagement rod engaging the first spring assembly while the force adjustment knob is in the first slot;

FIG. 7 is a partial cut-away side elevation view of the invention device taken along line 7—7 of FIG. 4, and particularly showing the spring engagement rod engaging the first, second and third spring assemblies;

FIG. 8 is an expanded view of the left end of FIG. 6 and useful in explaining detail of the force adjustment knob construction;

DESCRIPTION OF THE PREFERRED EMBODIMENT

Figure 1:
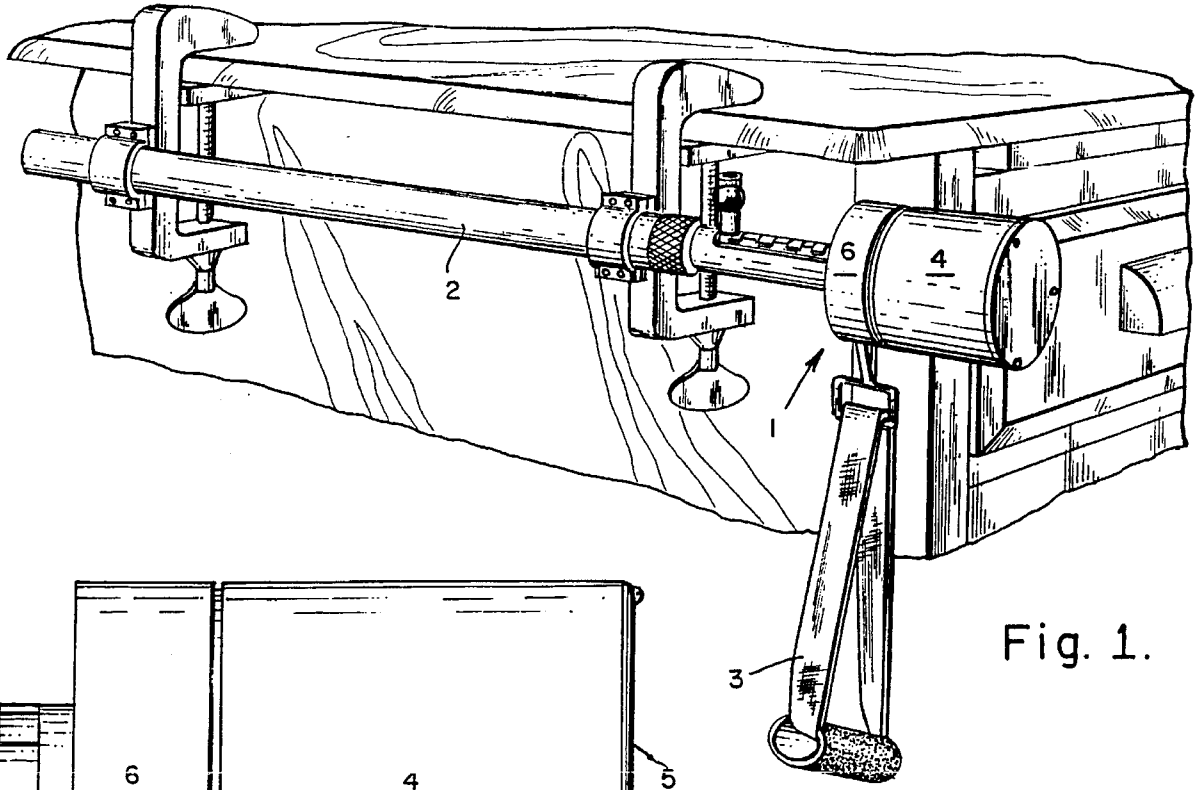
FIG. 1 is a perspective view of the invention exercise device ready for use and fastened to clamps which are fastened to a desk top.

Referring particularly to the drawings, there is shown in FIG. 1 a preferred embodiment of the invention exercise device 1 as attached by a clamp extension 2 to the edge of a desk. The device pull-handle 3 is hanging down and the device 1 is not being used. If the device 1 was in the process of being used for exercise, its pull-handle 3 would be extended outwards, displaying an amount of taut cord from the handle to a pulley inside the pulley housing 6 of the device. The device 1 has a pulley/spring housing 4 which would be rotating round its cylindrical axis as the handle 3 pulled the cord Or the cord was allowed to retract.

The device 1 is designed so that one of five different levels of pull force, ranging from 5 pounds to 25 pounds in steps of 5 pounds, may be selected by the user. However, these pull force levels may be changed in manufacturing to other levels, depending on the user demand.

Figure 2:
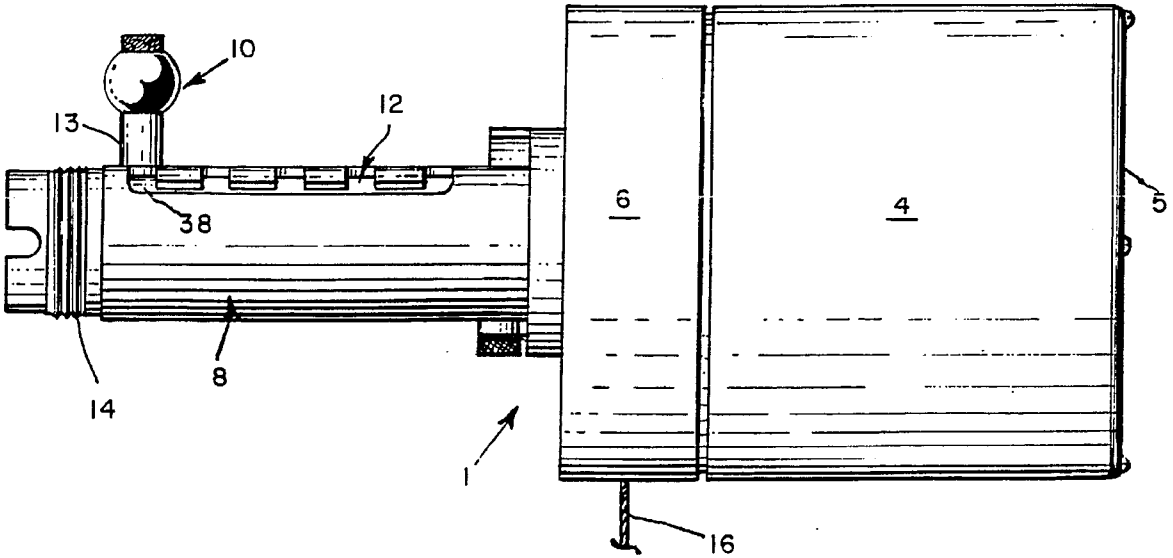
FIG. 2 is a side elevation view of the exercise device according to the present invention.

Refer now to FIGS. 2 and 3. FIG. 2 is a side elevation view and FIG. 3 is an end view of the exerciser device 1. From the outside can be seen a pulley/spring housing 4, a pulley housing 6, a selector housing 8 and a force adjustment knob 10.

The force adjustment knob 10 is shown located in the first or lowest force level location in the adjustment slot 12. The knob 10 is spring loaded so that its sleeve-body 13 rests firmly into a recess around the slot 12 and is guided through the slot in the selector housing 8, through a plug 38 to bear against a spring engagement rod 18 which is inside the selector housing 8. Since it is spring loaded, the knob 10 will remain in the selected position until manually released and moved through the adjustment slot 12 to another position.

A pull handle 3 is attached to a cord 16 which is wound around a pulley inside the device and shielded by the pulley housing 6.

In order to facilitate attachment of the device 1 to a clamp or other attachment as shown in FIG. 1, a screw thread. 14 is provided near the open end of the force selector housing 8. The entire device is only a few inches in diameter and weighs about three pounds so that it is small, compact and easy to move about.

Refer now to FIG. 4 which shows a side view of the spring engagement rod 18. The rod 18 is cylindrical in shape, is made of metal and for about 60% of its length, the rod 18 has longitudinal splines 20 over-its circumference. At its non-splined end, the rod 18 includes a flat 22 cut in it. The flat 22 provides a surface against which the bottom surface of the adjustment knob 10 can bear. The splines 20 are sized for engagement with grooves in the hubs of spring assemblies which are located inside the pulley/spring housing 4 and which are described later herein.

FIG. 5 is a top plan view of the selector housing 8. The selector housing 8 is a metal cylinder having one end portion stepped down 24 in diameter. The larger diameter end of the selector housing 8 is machine threaded 14 to facilitate attachment of the device to a clamp or other holding extension. The smaller diameter end of the housing is partly machine threaded to accept a locknut for fastening to the inside of the pulley/spring assembly 4.

As shown in FIG. 5, a number of evenly separated lateral slots 12 are cut in the surface of the large diameter portion and the bottom of each lateral slot 12 is connected with a longitudinal slot. At the end of each lateral slot 12, a circular recess 9 is cut to provide seating for the adjustment knob sleeve-body 13. The slots 12 are located to provide means for selecting the position of the spring engagement rod 18 in the selector housing 8 to engage with spring assemblies **26*a* inside the pulley/spring assembly 4. Therefore, the lateral slots 12 are positioned apart such that the distance between the center of the first lateral slot and the center of the last lateral slot corresponds to the distance between centers of the first and last spring assembly 26*a* inside the pulley/spring assembly 4**.

The inside diameter of the stepped down portion 24 of the selector housing 8 is sized to accommodate the diameter of the spring selector rod 18 and to provide a guide for the rod.

Refer now to FIGS. 6, 7 and 8 which are cross-section side elevation views of the device taken along lines 6,7—6,7 of FIG. 3. FIG. 7 is a partial cross-section only while FIG. 8 represents a more detailed view of the left end of FIG. 6. Referring particularly to FIG. 6, the internal arrangement of the complete device, excepting the pull handle 3, is shown. The device is seen to comprise a force selector assembly, a pulley shield 6, a pulley/spring assembly and a pull handle 3 (not shown in FIG.6). The pulley shield 6 is fitted over the stepped end of the selector housing and the force selector assembly is attached to the pulley/spring assembly by the projection of the selector housing 8 small diameter end 24 through central bearings 34 in the pulley 30 and fastened by a lock-nut 36. A pull handle 3 is connected to the pulley/spring assembly by the end of a cord 16 which is wound around the pulley 30.

The force selector assembly comprises: a selector housing 8, a spring engagement rod 18 located inside the selector housing 8, an adjustment knob 10, and a wedge member 38 located inside the selector housing 8 underneath the adjustment knob 10. The pulley shield 6 is made of hard plastic material and has a hub which fits over the stepped portion 24 of the selector housing at the step.

A screw with a knurled head 32 screws into the side Of the selector housing 8 and acts as a stop against an indented edge of the pulley shield hub, preventing the pulley shield 6 from rotating more than 180 deg, which is undesirable.

The pulley/spring assembly comprises a hard plastic pulley/spring housing 4, five spring assemblies **26*a* comprising a spring section 26 inside the housing 4, a housing end cover 5, and a length of cord 16 wound around the pulley 30 of the pulley/spring housing 4. The end cover 5 is screwed on to the end of the pulley/spring housing 4, enclosing the spring section 26** inside.

Figure 9:
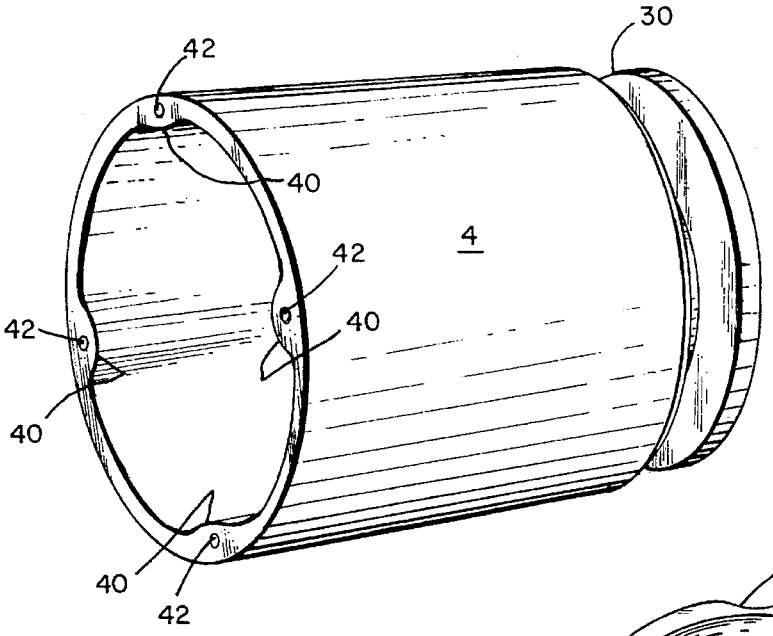
FIG. 9 is a perspective view of the spring housing, with its end cap removed showing four raised locating splines arranged around the inside surface of the housing.

The pulley/spring housing 4 which is illustrated in FIG. 9, is a cylinder which is open at one end and has a pulley 30 molded in its closed end. Thus, pulling on the cord 16 which is wound around the pulley 30 applies torque to the pulley/spring housing 4, causing it to rotate.

Figure 11:
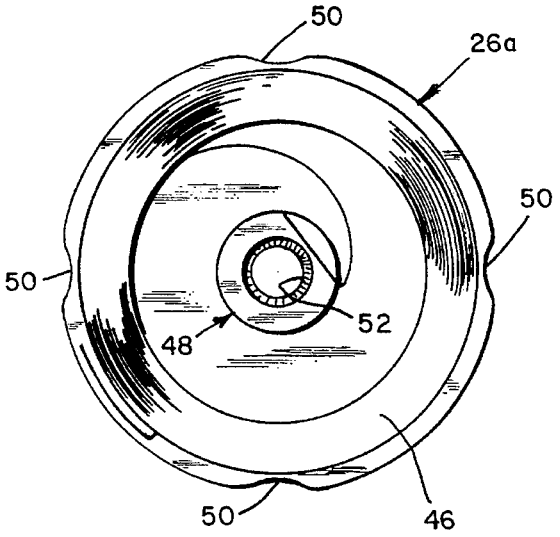
FIGS. 10 and 11 are respectively, a back plan view of a spring assembly, and a front plan view of a spring assembly according to the present invention device.
Figure 10:
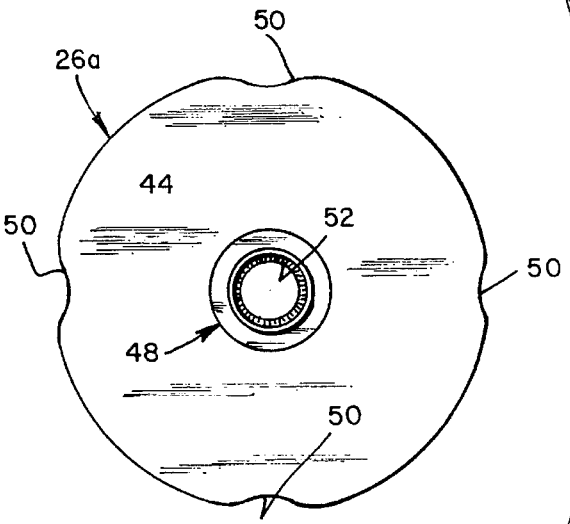

The spring assemblies **26*a*, which are illustrated in FIGS. 10 and 11, are metal disks having a grooved hub 48 at their center and a constant force spring connecting the hub 48 to the rim of the assembly. When the five spring assemblies 26*a* are inserted into the pulley/spring housing 4, the spring assemblies 26*a* are keyed in place and will therefore rotate as the pulley/spring housing 4** rotates.

Referring particularly to FIG. 6, the splined end 20 of the spring engagement rod 18 is shown engaging the hub of only the first spring assembly **26*a*, the adjustment knob 10 being in the first force slot. If the cord 16 is now pulled, only the first spring assembly will present an opposing force to the pull, transmitted through the pulley/spring housing 4 to the pulley and to cord 16**. If the springs are 5 pound constant force springs, the opposing force will be 5 pounds.

Similarly, if the splines 20 of the spring engagement rod 18 are made to engage the first three spring assemblies as shown in the partial illustration of FIG. 7, the first three spring assemblies will present an opposing force of three times 5 pounds, or 15 pounds force toga pull on the cord. Thus, the amount of spring force applied depends on the number of spring assemblies engaged by the splines 20 of the spring engagement rod 18.

The number of spring assemblies engaged is selected by the exercise user, who moves the adjustment knob 10 to seat in the slot corresponding to the required number.

Refer now to FIG. 8 which is a partial cut-away view of the open end of the force selector assembly, particularly showing detail of the construction of the adjustment knob 10. The adjustment knob 101together with the slots 12 in the selector housing embody the preferred means for adjusting the position of the spring engagement rod 18.

In this embodiment, the adjustment knob 10 is constructed using a sleeve 13 inside which is placed a spring portion 11 having a knurled head at one end and a threaded plug on the other end. The threaded plug is fastened to the wedge portion 38 inside the selector housing 8, so that the plug bears hard on the flat surface 22 of the selector rod 18. The extended internal spring 11 acts to pull the sleeve 13 down to seat in a recessed portion 9 which is around the end of every lateral slot 12. The adjustment knob 10 is thus spring loaded and is released by pulling up on the sleeve 13 ends.

Spring loaded knobs of various designs have long been available, and any one would do as long as it could be made to seat in the recessed portion 9 around the slot 12 ends and bear on the end of the spring engagement rod.

Referring to FIG. 9, a perspective view of the pulley/spring housing 4 is shown. The end cover 5 is not shown. Arranged around the inside surface of the housing 4 are a number of wide splines 40 which run the length of the cylinder inside surface. These splines 40 are half of the arrangement for keying the spring assemblies **26*a* in place inside the housing 4. It should be noted that the splines 40** are made wide in order to transmit high levels of torque to the spring assemblies without breaking.

Threaded holes 42 are tapped in the housing 4 end edge to allow fastening the end cover 5 in place.

Figure 12:
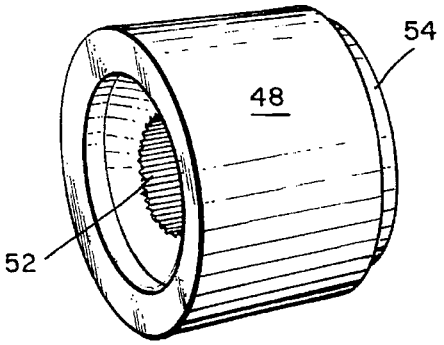
FIG. 12 is a perspective view of an internally grooved hub that is inserted in the center of the spring assembly and which retains an end of the spring.

Refer now to FIGS. 10, 11 which are, respectively, a back plan view and a front plan view of a spring assembly **26*a*, and to FIG. 12 which is a perspective view of a hub portion 48. A spring assembly 26*a* is made up of metal spring holder 44, a constant force coiled spring 46 and a metal hub portion 48. The spring holder 44 has a hole cut in its center in which is placed the hub portion 48. The spring holder 44 is permitted to rotate with respect to its hub portion 48. The spring 46 is attached at its outer end to the rim of the spring holder 44, and at its inner end to a slit in the hub portion 48**.

Around the circumference edge of the spring holder 44 are located a number of wide grooves 50 cut in the surface. These grooves 50 match in quantity and location the splines 40 raised on the inside of the pulley/spring housing 4, and are sized to fit snugly over the splines so that the spring assemblies **26*a* can be keyed into the pulley/spring housing 4** and slid into place.

The hub portion 48 is a short cylindrical metal piece which has a stepped outer diameter 54 at one end and a recessed diameter cut in its distal end. The stepped diameter 54 is sized to fit snugly inside the recessed diameter of any other hub portion. The central hole in the axis of the hub portion is grooved 52 longitudinally with grooves matching the splines 20 on the spring engagement rod 18. This is done to permit tight engagement of the hub and the rod without slippage.

When the spring assemblies **26*a* are placed one after the other inside the pulley/spring housing 4, their hubs nest one inside the recess of the next hub in line. This accurately lines up the grooved hole inside the hubs so that each can be properly engaged by the spring engagement rod 18**.

In operation, the force selector assembly, including the spring engagement rod 18, does not move or rotate. Only the pulley/spring assembly will rotate one its bearings 34 over the end of the selector housing 8. Thus, the axis of the device around which the pulley/spring assembly rotates can be held in any convenient orientation. The only thing required is that the selector housing 8 be held firmly. This can be done by screwing a clamp attachment to the end of the selector housing and clamping it to a relatively immovable object as shown in FIG. 1. Or the device can be attached to any suitable handle which can be held rigid.

The exerciser device may also be incorporated in static equipment, using several devices attached to the static equipment as desired. In general, the possible uses and applications of the equipment are many, reflecting the versatility and compact design of the device.

The chief attribute and advantage of the invention device is its obvious portability and use anywhere. This advantage, coupled with the provision of an easy manual selection of five levels of pulling force, makes the device an attractive addition to the presently available athletic exerciser equipments.

From the above description, it is clear that the preferred embodiment achieves the objects of the present invention. Alternative embodiments and various modifications may be apparent to those skilled in the art. These alternatives and modifications are considered to be within the spirit and scope of the present invention.

Having described the invention, what is claimed is:

1. An athletic exerciser pulling device, comprising in combination:

a force selector assembly comprising an elongated metal tubular member which serves as a selector housing, an elongated metal rod member which fits inside said tubular member, a spring-loaded adjustment knob for spring force selection, a plug member which fits inside said tubular member and a locknut; said tubular member having at one end, a stepped portion and at its distal end, a threaded portion to accept a fastening nut, said stepped portion including at its end a means for fastening said locknut to said tubular member, said tubular member including means for selecting the device spring force using said adjustment knob; said rod member, having a splined portion of its length from its proximal end covered with longitudinal splines placed close together for the purpose of engagement with spring assemblies, and including a flat portion cut for a short length near its distal end; said plug member including a central bore to support said flat portion of said rod member when inside said tubular member;

a pulley shield made of molded hard plastic, said shield being shaped as a shallow cylinder, having one end fully open and its opposite end having a circular hole at its center axis, said opposite end including a hub formed around said circular hole, said hub being sized to fit over the step of said stepped portion of said tubular member in said force selector assembly, said pulley shield including a second hole in its outer cylindrical surface, permitting a cord to be passed through said second hole;

a pulley/spring assembly comprising a molded plastic pulley/spring housing, circular bushing bearings, a multiplicity of identical circular, constant force spring assemblies, means for keying and retaining said constant force spring assemblies in said pulley/spring housing so that said constant force spring assemblies are tightly gripped by said pulley/spring housing, a length of strong cord and a housing end cover;

said pulley/spring housing being a hollow cylinder, open at one end and having a pulley molded on at its distal end, said pulley including a first hole bored through its center axis of rotation corresponding with the center longitudinal axis of said pulley/spring housing, said first hole sized to snugly accommodate said circular bushing bearings, said pulley outer diameter being sized to fit inside said pulley shield with clearance;

said constant force spring assemblies each including an engaging hub component having a bore at its center axis with multiple longitudinal grooves in said bore surface, said grooves matching in size and number said longitudinal splines on the splined portion of said rod member to facilitate engagement of said rod member with said constant force spring assemblies;

said cord having one end fastened to the hub of said pulley and being wound around said pulley sufficiently until a small portion of said cord is available for pulling; said housing end cover being a circular disk of plastic which is fastened to the open end of said pulley/spring housing after said constant force spring assemblies are inserted; and a pull-handle, said pull-handle being fastened to said cord after said cord is pulled through said second hole in said pulley shield;

in assembly of said device, said force selector assembly and said pulley shield having the stepped portion of said selector housing pushed through the center of said bushing bearings in said pulley and fastened by said locknut to the inside wall of said pulley/spring housing, said constant force spring assemblies then being placed inside said pulley/spring housing and said housing end cover fastened to the open end of said pulley/spring housing;

said rod member inside said selector housing being engaged by said spring-loaded adjustment knob and capable of being moved into said pulley/spring assembly by manual movement of said spring-loaded adjustment knob, until the splined portion of said rod member engages a desired number of spring assemblies as selected using said means for selecting the device spring force; said device when an exerciser pulls at the pull-handle, producing a constant opposing force at the selected force level.

2. An athletic exerciser pulling device according to claim 1 wherein said means for selecting the device spring force using said adjustment knob includes a multiplicity of lateral slots cut in the surface of said tubular member in said force selector assembly, said lateral slots being evenly spaced apart so that the distance from the center of the first lateral slot to the center of the last lateral slot is equal to the distance between the thickness centers of the first and last constant force spring assemblies inside said pulley/spring assembly, said lateral slots being connected at their proximal end by a longitudinal slot, said lateral slots each having a recessed portion around their distal end for the purpose of providing a fixed seat for the sleeve of said adjustment knob, said adjustment knob being connected to an end of said metal rod member, and cooperating with said lateral slots and said longitudinal slot to move said metal rod member such that said metal rod member engages a number of said constant force spring assemblies equivalent to the sequence number of the lateral slot occupied by said adjustment knob.

3. An athletic exerciser pulling device according to claim 1 wherein said means for keying and retaining said constant force spring assemblies into said pulley/spring housing includes a multiplicity of wide longitudinal splines located evenly around the inside surface of said pulley/spring housing, and a multiplicity of wide grooves cut axially and located evenly around the outer perimeter of each said constant force spring assembly, said splines and said grooves matching in quantity, width and exact circumference location to ensure that said grooves fit snugly over said splines when said constant force spring assemblies are inserted into said pulley/spring housing.

4. An athletic exerciser pulling device according to claim 1 wherein said engaging hub component in said constant force spring assembly includes a circular recessed portion at its proximal end around said bore and a stepped diameter portion at its distal end, said stepped diameter portion sized to fit snugly into said recessed portion of another engaging hub component when said constant spring force assemblies are inserted into said pulley/spring housing, thereby lining up said bore in each engaging hub component as required for engagement with the splines of said metal rod member.

* * * * *